United States Patent [19]

Handley

[11] Patent Number: 5,041,149

[45] Date of Patent: Aug. 20, 1991

[54] SEPARATION OF NITROGEN AND METHANE WITH RESIDUE TURBOEXPANSION

[75] Inventor: James R. Handley, Amherst, N.Y.

[73] Assignee: Union Carbide Industrial Gases Technology Corporation, Danbury, Conn.

[21] Appl. No.: 599,415

[22] Filed: Oct. 18, 1990

[51] Int. Cl.[5] ..... F25J 3/02

[52] U.S. Cl. ..... 62/27; 62/31; 62/39

[58] Field of Search ..... 62/11, 23, 24, 27, 28, 62/38, 39, 31

[56] References Cited

U.S. PATENT DOCUMENTS

| | | | |
|---|---|---|---|
| 3,531,943 | 10/1970 | Parnag et al. | 62/28 |
| 3,797,261 | 3/1974 | Juncker et al. | 62/39 |
| 4,158,556 | 6/1979 | Yearout | 62/28 |
| 4,352,685 | 10/1982 | Swallow | 62/28 |
| 4,415,345 | 11/1983 | Swallow | 62/28 |
| 4,479,871 | 10/1984 | Pahade et al. | 208/340 |
| 4,501,600 | 2/1985 | Pahade | 62/28 |
| 4,592,767 | 6/1986 | Pahade et al. | 62/31 |
| 4,619,679 | 10/1986 | DeLong | 62/39 |
| 4,664,686 | 5/1987 | Pahade et al. | 62/24 |
| 4,710,212 | 12/1987 | Hanson et al. | 62/23 |
| 4,732,598 | 3/1988 | Rowles et al. | 62/39 |
| 4,778,498 | 10/1988 | Hanson et al. | 62/28 |
| 4,878,932 | 11/1989 | Pahade et al. | 62/24 |
| 4,936,888 | 6/1990 | DeLong | 62/24 |

*Primary Examiner*—Ronald C. Capossela

*Attorney, Agent, or Firm*—Stanley Ktorides

[57] ABSTRACT

A method for separating nitrogen and methane by cryogenic distillation wherein methane residue is turboexpanded to generate refrigeration to drive the separation.

7 Claims, 2 Drawing Sheets

SEPARATION OF NITROGEN AND METHANE WITH RESIDUE TURBOEXPANSION

TECHNICAL FIELD

This invention relates generally to the separation of nitrogen and methane by cryogenic rectification and is an improvement whereby residual methane recovery is attained at higher pressure.

BACKGROUND ART

One problem often encountered in the production of natural gas from underground reservoirs is nitrogen contamination. The nitrogen may be naturally occurring and/or may have been injected into the reservoir as part of an enhanced oil recovery (EOR) or enhanced gas recovery (EGR) operation. Natural gases which contain a significant amount of nitrogen may not be saleable, since they do not meet minimum heating value specifications and/or exceed maximum inert content requirements. As a result, the feed gas will generally undergo processing, wherein heavier components such as natural gas liquids are initially removed, and then the remaining stream containing primarily nitrogen and methane is separated cryogenically. A common process for separation of nitrogen from natural gas employs a double column distillation cycle, similar to that used for fractionation of air into nitrogen and oxygen.

A recent significant advancement in such a process is described in U.S. Pat. No. 4,878,932—Pahade et al wherein the nitrogen-methane feed is separated using a single column nitrogen rejection unit (NRU) which also includes a phase separator. Another recent significant advancement in this field is disclosed in U.S. Pat. No. 4,664,686—Pahade et al wherein a stripping column is employed upstream of the NRU. These advancements enable the use of lower pressure feed for the separation.

It is desirable to recover residue methane at as high a pressure as possible in order to reduce pipeline compression requirements. One way of achieving this is to employ the compressed feed gas as a refrigeration source by means of Joule-Thompson or valve expansion of return streams. However, in low feed pressure situations the requisite feed compression is inefficient because the Joule-Thompson effect generated by returning nitrogen is small.

Accordingly, it is an object of this invention to provide a method wherein lower pressure nitrogen-methane feed may be more effecitvely employed in a nitrogen rejection unit.

SUMMARY OF THE INVENTION

The above and other objects which will become apparent to one skilled in the art upon a reading of this disclosure are attained by the present invention which, in general, comprises the turboexpansion of a methane residue stream to reduce the temperature of the residue stream and the use of the cooled residue stream, to transfer refrigeration to the incoming feed.

More specifically, one aspect of the invention comprises:

A method for separating nitrogen and methane comprising:

(a) cooling a feed comprising nitrogen and methane at a pressure within the range of from 80 to 600 psia;

(b) separating the feed by cryogenic rectification in a nitrogen rejection unit comprising at least one column into nitrogen-enriched vapor and methane-enriched liquid;

(c) vaporizing the methane-enriched liquid to produce methane-enriched vapor;

(d) turboexpanding the methane-enriched vapor to reduce the temperature of the methane-enriched vapor; and (e) passing the turboexpanded methane-enriched vapor in indirect heat exchange with the feed to carry out the cooling of step (a).

Another aspect of the invention comprises:

A method for separating nitrogen and methane comprising:

(a) cooling a feed comprising nitrogen and methane at a pressure within the range of from 80 to 600 psia and passing the cooled feed through a stripping column for separation into nitrogen-richer vapor and methane-richer liquid;

(b) separating the nitrogen-richer vapor by cryogenic rectification in a nitrogen rejection unit comprising at least one column into nitrogen-enriched vapor and methane-enriched fluid;

(c) vaporizing the methane-richer liquid to produce methane-richer vapor;

(d) turboexpanding the methane-richer vapor to reduce the temperature of the methane-richer vapor; and (e) passing the turboexpanded methane-richer vapor in indirect heat exchange with the feed to carry out the cooling of step (a)

The term "column" is used herein to mean a distillation, rectification or fractionation column, i.e., a contacting column or zone wherein liquid and vapor phases are coutercurrently contacted to effect separation of a fluid mixture, as for example, by contacting of the vapor and liquid phases on a series of vertically spaced trays or plates mounted within the column, or on packing elements, or a combination thereof. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al, page 13—3, *The Continuous Distillation Process.*

The term "double column", is used herein to mean a high pressure column having its upper end in heat exchange relation with the lower end of a low pressure column. An expanded discussion of double columns appears in Ruhemann, "The Separation of Gases" Oxford University Press, 1949, Chapter VII, Commercial Air Separation.

The terms "nitrogen rejection unit" and "NRU" are used herein to mean a facility wherein nitrogen and methane are separated by cryogenic rectification, comprising at least one column and the attendant interconnecting equipment such as liquid pumps, phase separators, piping, valves and heat exchangers.

The term "indirect heat exchange" is used herein to mean the bringing of two fluid streams into heat exchange relation without any physical contact or intermixing of the fluids with each other.

The term "stripping column" is used herein to mean a column wherein feed is introduced into the upper portion of the column and more volatile components are removed or stripped from descending liquid by rising vapor.

The term "turboexpansion" is used herein to mean the conversion of the pressure energy of a gas into mechanical work by expansion of the gas through a device such as a turbine.

DETAILED DESCRIPTION

The invention will be described in detail with reference to the drawings.

Figure 1:
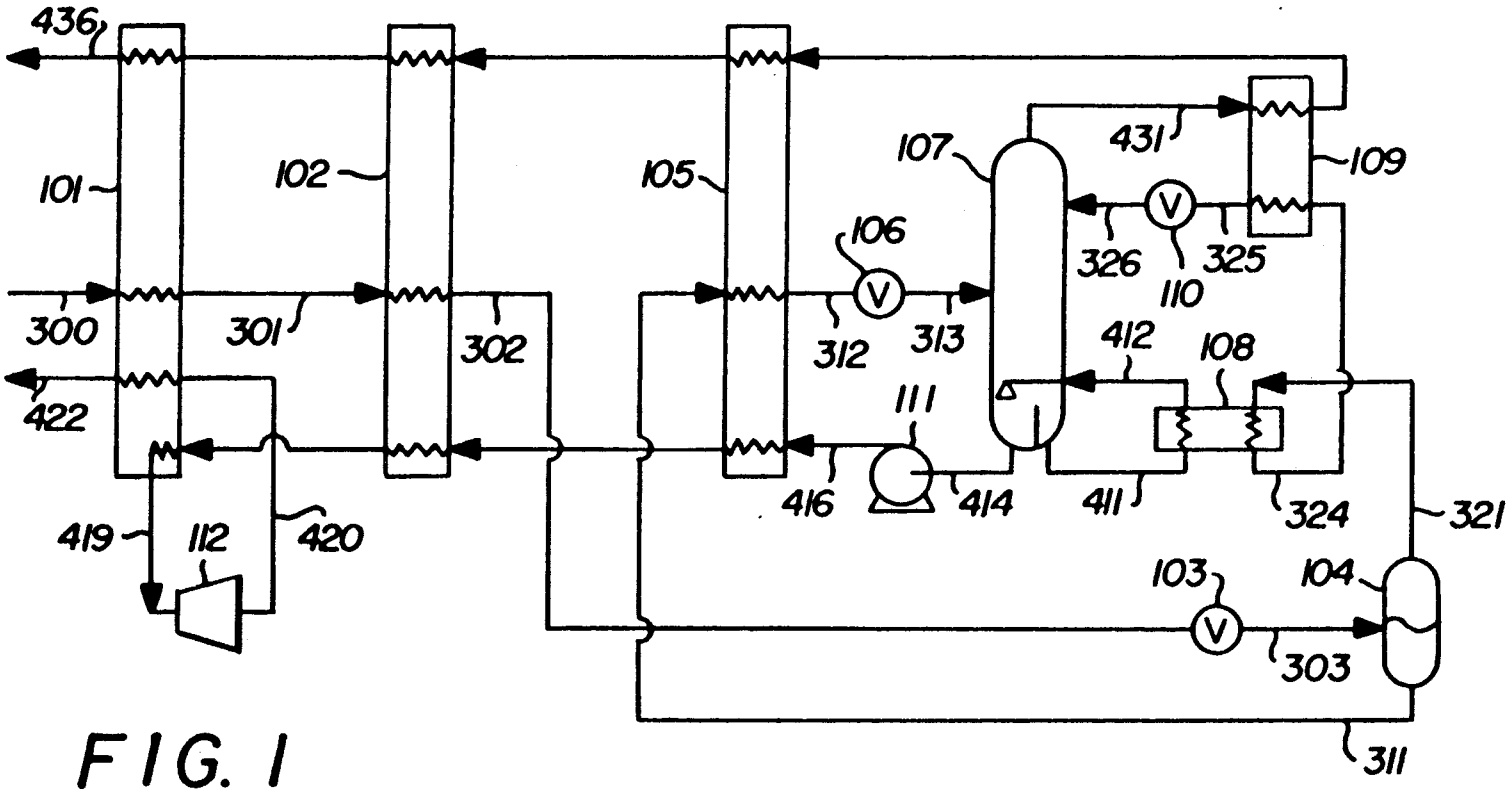
FIG. 1 is a schematic representation of one embodiment of the invention employed with a single column NRU.

Referring now to FIG. 1, feed 300, at a pressure within the range of from 80 to 600 pounds per square inch absolute (psia), is cooled by indirect heat exchange by passage through heat exchanger 101. Feed 300 comprises methane and nitrogen. Generally methane will comprise from 20 to 95 percent of feed 300 and nitrogen will comprise from 5 to 80 percent of feed 300. Feed 300 may also contain lower boiling or more volatile components such as helium, hydrogen and/or neon and higher boiling components such as heavier hydrocarbons. The cooled feed stream is then passed on to the NRU. Cooled feed stream 301 is further cooled and partially condensed by passage through heat exchanger 102 and resulting two phase stream 302 is reduced in pressure through valve 103 and passed 303 into phase separator 104.

Liquid 311 from phase separator 104 is subcooled by passage through heat exchanger 105. Subcooled stream 312 is passed through valve 106 and then as stream 313 into column 107 at about the midpoint of the column. Column 107 is a single column of the NRU and is operating at a pressure within the range of from 15 to 200 psia. Vapor 321 from phase separator 104 is condensed by passage through heat exchanger 108 and resulting stream 324 subcooled by passage through heat exchanger 109. Subcooled stream 325 is passed through valve 110 and then passed 326 into column 107 at a point above the point where stream 313 is passed into the column. In this way liquid reflux is provided into column 107.

Within column 107 the feed is separated by cryogenic rectification into nitrogen-enriched vapor and methane-enriched liquid. Nitrogen-enriched vapor is removed from column 107 as stream 431 and warmed by passage sequentially through heat exchangers 109, 105, 102 and 101. Resulting stream 436 may be recovered, used directly in enhanced oil or gas recovery, or simply released to the atmosphere.

Bottoms from column 107 are passed out of the column in stream 411 and at least partially vaporized by passage through heat exchanger 108 against condensing stream 321 from phase separator 104. Resulting stream 412 is returned to column 107 so as to provide vapor upflow to column 107. Methane-enriched liquid is removed from column 107 as stream 414 and pumped to a pressure generally within the range from 30 to 500 psia through pump 111. Resulting methane-enriched liquid in stream 416 is warmed and vaporized by passage through heat exchangers 105 and 102 and passed partially through heat exchanger 101. Resulting methane-enriched vapor in stream 419 is turboexpanded through turboexpander 112 so as to reduce the pressure and the temperature of this residue methane-enriched vapor. The turboexpander is a device that converts the pressure energy of a gas into mechanical work by the expansion of the gas. The internal energy of the gas is reduced as work is produced thus lowering the temperature of the gas. Therefore, the turboexpander acts as a refrigerator as well as a work producing device.

The resulting turboexpanded residue stream 420 is passed through heat exchanger 101 wherein it serves to cool incoming feed 300 and thus pass on refrigeration into the NRU. Warmed residue stream 422 may then be recovered as methane product gas.

Figure 2:
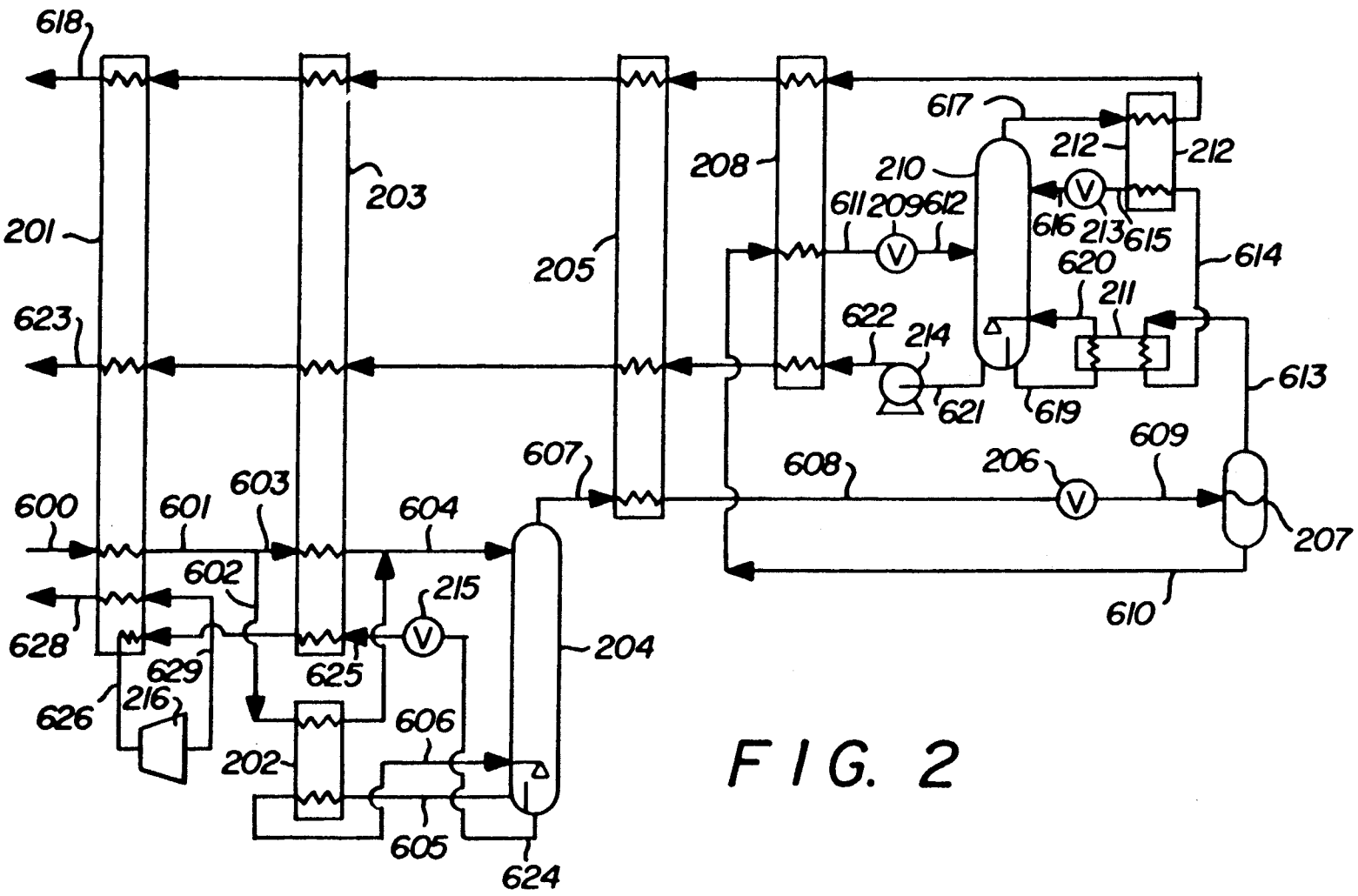
FIG. 2 is a schematic representation of another embodiment of the invention employed with a stripping column upstream of an NRU.

FIG. 2 illustrates another embodiment of the invention wherein a stripping column is employed upstream of the NRU. Referring now to FIG. 2, feed 600, at a pressure within the range of from 80 to 600 psia, is cooled by indirect heat exchange by passage through heat exchanger 201. Feed 600 comprises methane and nitrogen. Generally methane will comprise from 20 to 95 percent of feed 600 and nitrogen will comprise from 5 to 80 percent of feed 600. Resulting cooled stream 601 is divided into stream 602 which is cooled by passage through heat exchanger 202 and into stream 603 which is cooled by passage through heat exchanger 203. Streams 602 and 603 are at least partially condensed by these heat exchange steps. These streams are then recombined into stream 604 which is passed into stripping column 204 at or near the top of the column. Stripping column 204 is operating at a pressure within the range of from 80 to 600 psia.

Within stripping column 204 the feed is separated into nitrogen-richer vapor and methane-richer liquid. Bottoms from stripping column 204 are removed as stream 605 and at least partially vaporized by passage through heat exchanger 202 against stream 602 and returned as stream 606 to stripping column 204 thus providing stripping vapor for the column. Nitrogen-richer vapor is removed from column 204 as stream 607 and passed on to the NRU. The nitrogen-richer vapor comprises both nitrogen and methane and has a nitrogen concentration greater than that of the feed.

Nitrogen-richer stream 607 is cooled and partially condensed by passage through heat exchanger 205 and resulting two phase stream 608 is reduced in pressure through valve 206 and passed 609 into phase separator 207.

Liquid 610 from phase separator 207 is subcooled by passage through heat exchanger 208. Subcooled stream 611 is passed through valve 209 and then as stream 612 into column 210 at about the midpoint of the column. Column 210 is a single column of the NRU and is operating at a pressure within the range of from 15 to 200 psia. Vapor 613 from phase separator 207 is condensed by passage through heat exchanger 211 and resulting stream 614 subcooled by passage through heat exchanger 212. Subcooled stream 615 is passed through valve 213 and then passed 616 into column 210 at a point above the point where stream 612 is passed into the column. In this way liquid reflux is provided into column 210.

Within column 210 the fluids resulting from stream 607 are separated by cryogenic rectification into nitrogen-enriched vapor and methane-enriched fluid, i.e. liquid. Nitrogen-enriched vapor is removed from column 210 as stream 617 and warmed by passage sequentially through heat exchangers 212, 208, 205, 203 and 201. Resulting stream 618 may be recovered, used directly in enhanced oil or gas recovery, or simply released to the atmosphere.

Bottoms from column 210 are passed out of the column as stream 619 and at least partially vaporized by passage through heat exchanger 211 against condensing stream 613 from phase separator 207. Resulting stream 620 is returned to column 210 so as to provide vapor upflow to column 210. Methane-enriched liquid is removed from column 210 as stream 621 and pumped to a pressure generally within the range of from 30 to 500 psia through pump 214. The fluid in resulting stream 622 is warmed by passage through heat exchangers 208, 205, 203 and 201 and may be recovered as methane gas product stream 623.

Methane-richer liquid is removed from stripping column 204 in stream 624, passed through valve 215 and passed 625 through heat exchanger 203 and partially through heat exchanger 201 wherein it is vaporized to produce methane-richer vapor. Resulting methane-richer vapor in stream 626 is turboexpanded through turboexpander 216 so as to reduce the pressure and the temperature of this residue vapor. The resulting turboexpanded residue in stream 627 is passed through heat exchanger 201 wherein it serves to cool incoming feed 600 and thus pass on refrigeration into the stripping column and then into the NRU. The warmed residue stream 628 may then be recovered as methane product gas.

In a variation to the turboexpansion and subsequent heat exchange discussed above, a portion of stream 625 may be passed straight through heat exchanger 201 and the other portion employed as stream 626 for passage through turboexpander 216. Subsequently, turboexpanded stream 627 may be combined with methane-enriched fluid in stream 622 between heat exchangers 203 and 201 and the combined stream passed through heat exchanger 201 for cooling the incoming feed.

By use of the method of this invention, one can provide refrigeration to an NRU while reducing or eliminating feed compression requirements. This is particularly useful in those instances where a high pressure feed is not available as such feed compression would entail a process inefficiency because the Joule-Thompson cooling obtainable from the nitrogen return stream due to the feed compression is not large. By generating refrigeration using turboexpansion of methane residue, feed compression is reduced and, moreover, methane residue can be recovered at a higher pressure than would otherwise be the case. The development of the required system refrigeration by efficient turboexpansion rather than Joule-Thompson expansion conserves the methane residue pressure.

Although the invention has been described in detail with reference to certain embodiments, those skilled in the art will recognize that there are other embodiments within the spirit and scope of the claims. For example, although the NRU has been illustrated as comprising a single column, the NRU may include a plurality of columns including a double column arrangement.

I claim:

1. A method for separating nitrogen and methane comprising:

(a) cooling a feed comprising nitrogen and methane at a pressure within the range from 80 to 600 psia;

(b) separating the feed by cryogenic rectification in a nitrogen rejection unit comprising at least one column into nitrogen-enriched vapor and methane-enriched liquid;

(c) vaporizing the methane-enriched liquid to produce methane-enriched vapor;

(d) turboexpanding the methane-enriched vapor to reduce the temperature of the methane-enriched vapor; and (e) passing the turboexpanded methane-enriched vapor in indirect heat exchange with the feed to carry out the cooling of step (a).

2. The method of claim 1 wherein the cooled feed is partially condensed and the resulting vapor and liquid are provided into a single column at separate points to carry out the separation into nitrogen-enriched vapor and methane-enriched liquid.

3. The method of claim 1 wherein the methane-enriched liquid is pumped to a higher pressure prior to the vaporization and turboexpansion.

4. A method for separating nitrogen and methane comprising:

(a) cooling a feed comprising nitrogen and methane at a pressure within the range of from 80 to 600 psia and passing the cooled feed through a stripping column for separation into nitrogen-richer vapor and methane-richer liquid;

(b) separating the nitrogen-richer vapor by cryogenic rectification in a nitrogen rejection unit comprising at least one column into nitrogen-enriched vapor and methane-enriched fluid;

(c) vaporizing the methane-richer liquid to produce methane-richer vapor;

(d) turboexpanding the methane-richer vapor to reduce the temperature of the methane-richer vapor; and (e) passing the turboexpanded methane-richer vapor in indirect heat exchange with the feed to carry out the cooling of step (a).

5. The method of claim 4 wherein the nitrogen-richer vapor is partially condensed and the resulting vapor and liquid are provided into a single column at separate points to carry out the separation into nitrogen-enriched vapor and methane-enriched liquid.

6. The method of claim 4 further comprising passing methane-enriched fluid in indirect heat exchange with feed to provide additional cooling to the feed.

7. The method of claim 4 wherein methane-richer vapor and methane-enriched fluid are combined and the combined stream is employed to carry out the cooling of step (a).

* * * * *